US006831397B2

(12) United States Patent
Kanao et al.

(10) Patent No.: US 6,831,397 B2
(45) Date of Patent: Dec. 14, 2004

(54) SPARK PLUG AND A METHOD OF PRODUCING THE SAME

(75) Inventors: Keiji Kanao, Aichi-ken (JP); Tsunenobu Hori, Kariya (JP)

(73) Assignee: Denso Corporation (JP)

( * ) Notice: Subject to any disclaimer, the term of this patent is extended or adjusted under 35 U.S.C. 154(b) by 58 days.

(21) Appl. No.: 10/058,430

(22) Filed: Jan. 30, 2002

(65) Prior Publication Data

US 2002/0121849 A1 Sep. 5, 2002

(30) Foreign Application Priority Data

Feb. 8, 2001 (JP) ..... 2001-032474
Nov. 15, 2001 (JP) ..... 2001-350443

(51) Int. Cl.[7] ..... H01T 13/20
(52) U.S. Cl. ..... 313/141; 313/144
(58) Field of Search ..... 313/141, 142, 313/143, 144, 118; 447/7

(56) References Cited

U.S. PATENT DOCUMENTS 4,109,633 A 8/1978 Mitsudo et al.
4,700,103 A * 10/1987 Yamaguchi et al. ..... 313/141
4,786,267 A * 11/1988 Toya et al. ..... 445/7
5,124,612 A * 6/1992 Takamura et al. ..... 313/141
5,347,193 A * 9/1994 Oshima et al. ..... 313/141
5,811,915 A 9/1998 Abe et al.
5,977,695 A * 11/1999 Osamura et al. ..... 313/141
6,078,129 A * 6/2000 Gotou et al. ..... 313/141
6,093,071 A * 7/2000 Osamura et al. ..... 445/7
6,121,719 A * 9/2000 Matsutani et al. ..... 313/141
6,147,441 A * 11/2000 Osamura ..... 313/141
6,166,479 A * 12/2000 Matsutani et al. ..... 313/141
6,215,235 B1 4/2001 Osamura
6,304,022 B1 * 10/2001 Matsutani ..... 313/141
6,533,628 B1 * 3/2003 Matsutani ..... 445/7

FOREIGN PATENT DOCUMENTS

JP 52-36237 3/1977
JP 9-106880 4/1997
JP 11-233233 8/1999

* cited by examiner

*Primary Examiner*—Sandra O'Shea
*Assistant Examiner*—Dalei Dong
(74) *Attorney, Agent, or Firm*—Nixon & Vanderhye PC

(57) ABSTRACT

A noble metal chip of which one end is welded to an earth electrode by laser has a sectional area of not less than 0.12 $mm^2$ and not more than 1.15 $mm^2$ at the other end. A length from the surface of the earth electrode to the top surface of the noble metal chip is not less than 0.3 mm and not more than 1.5 mm. An outer surface of the fused junction layer obtained by laser welding between the noble metal chip and the earth electrode has a concave surface, wherein the slope on the plane including the axis of the noble metal chip is curved with a radius R.

9 Claims, 9 Drawing Sheets

40
41
43
45
45a
45b
47
49
61
α
β

SPARK PLUG AND A METHOD OF PRODUCING THE SAME

BACKGROUND OF THE INVENTION

1. Field of the Invention

This invention relates to a spark plug including a central electrode and an earth electrode having a chip including a noble metal to have a gap between the chip and the central electrode and to a method of producing the spark plug by laser welding.

2. Description of the Prior Art

The use of a noble metal chip at the tip of the earth electrode of a spark plug to form a spark gap between the chip and the central electrode provides a long effective life of the spark plug and/or reduces misfiring.

U.S. Pat. No. 6,215,235 discloses a spark plug in which a noble metallic firing chip is bonded on the opposing surface of either a central electrode or an earth electrode by laser welding. In this spark plug, the base electrode member (the central electrode or the earth electrode) has a slender tip with a noble metal chip welded thereto by laser to provide a long effective life and excellent ignitability.

U.S. Pat. No. 5,811,915 discloses a spark plug in which a noble metallic firing chip is sunk in the base electrode member, and then, the swelled portion around the chip is welded to the chip.

In these spark plugs, the noble metallic firing chips on the central electrodes are fixed with practically sufficient strengths. On the other hand, the noble metallic firing chips on the earth electrodes are fixed with practically insufficient strengths. This is caused by difference in the fixing condition. That is, the noble metallic firing chip on the central electrode is fixed near the body of the spark plug, so that thermal stress at the fused junction layer connecting the noble metallic firing chip to the central electrode is relatively low. On the other hand, the noble metallic firing chip on the earth electrode is fixed away from the body of the spark plug. In other words, the fused junction layer connecting the noble metal chip to the earth electrode is more exposed to the combustion chamber. Accordingly, the fused junction layer on the earth electrode is subjected to relatively high thermal stress. This may result in development of cracks and finally result in disconnection of the noble metallic chip from the earth electrode.

SUMMARY OF THE INVENTION

The aim of the present invention is to provide a superior spark plug and a superior method of producing the same.

According to the present invention, a first aspect of the present invention provides a spark plug comprising:

a tubular housing;

a central electrode supported by said tubular housing in said tubular housing with electrical insulation therebetween;

an earth electrode extending from one end of said tubular housing;

a chip, arranged at an end surface of said earth electrode to face said central electrode, for providing a spark gap between said central electrode and said chip, said chip including a novel metal; and a fused junction layer between said earth electrode and said chip including components of said chip and said earth electrode to fix said chip to said earth electrode, wherein a cross-sectional area of said chip at a tip thereof on the opposite side of said fused junction layer is not less than 0.12 $mm^2$ and not more than 1.15 $mm^2$, and a length from said end surface to a top surface of said tip is not less than 0.3 $mm^2$ and not more than 1.5 $mm^2$, and wherein said fused junction layer has substantially a conical outer surface continuously connecting a peripheral outer surface of said chip to said end surface of said earth electrode with a radius on a sectional plane along an axis of said chip.

According to the present invention, a second aspect of the present invention provides a spark plug based on the first aspect, wherein if it is assumed that a maximum width of said chip on a sectional plane along said axis is D and that said radius is R, $D/4 \leqq R \leqq 3D/4$.

According to the present invention, a third aspect of the present invention provides a spark plug based on the first aspect, wherein said chip mainly includes Ir and further includes at least one of Rh, Pt, Ni, W, Pd, Ru, and Os.

According to the present invention, a fourth aspect of the present invention provides a spark plug based on the third aspect, wherein said chip mainly includes Ir and further includes at least one of Rh of lower than or equal to 50% by weight, Pt of lower than or equal to 50% by weight, Ni of lower than or equal to 40% by weight, W of lower than or equal to 30% by weight, Pd of lower than or equal to 40% by weight, Ru of lower than or equal to 30% by weight, and Os of lower than or equal to 20% by weight.

According to the present invention, a fifth aspect of the present invention provides a spark plug based on the first aspect, wherein said chip mainly includes Pt and further includes at least one of Ir, Ni, Rh, W, Pd, Ru, and Os.

According to the present invention, a sixth aspect of the present invention provides a spark plug based on the third aspect, wherein said chip mainly includes Pt and further includes at least one of Ir of lower than or equal to 50% by weight, Ni of lower than or equal to 40% by weight, Rh of lower than or equal to 50% by weight, W of lower than or equal to 30% by weight, Pd of lower than or equal to 40% by weight, Ru of lower than or equal to 30% by weight, and Os of lower than or equal to 20% by weight.

According to the present invention, a seventh aspect of the present invention provides a spark plug based on the third aspect, wherein said fused junction layer includes said component of said chip of not less than 35% by weight and not more than 80% by weight.

According to the present invention, an eighth aspect of the present invention provides a spark plug based on the fifth aspect, wherein said fused junction layer includes said component of said chip of not less than 35% by weight and not more than 80% by weight.

According to the present invention, a ninth aspect of the present invention provides a method of producing a spark plug including a tubular housing, a central electrode supported by said tubular housing in said tubular housing with electrical insulation therebetween, and an earth electrode extending from one end of said tubular housing, comprising the steps of:

placing said chip including a noble metal on a surface of a tip of said earth electrode with contact between an end surface of said chip and said surface; and welding said chip to said surface by applying a laser beam toward a corner made between said surface and a side surface neighboring said end surface of said chip at an inclined angle to said end surface and said side surface.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

[First Embodiment]

The spark plug S1 according to the first embodiment is used in an engine for a motor vehicle. The spark plug S1 is inserted into a threaded through hole in the engine head (not shown) and screwed on to expose its spark gap to the combustion chamber.

Figure 1:
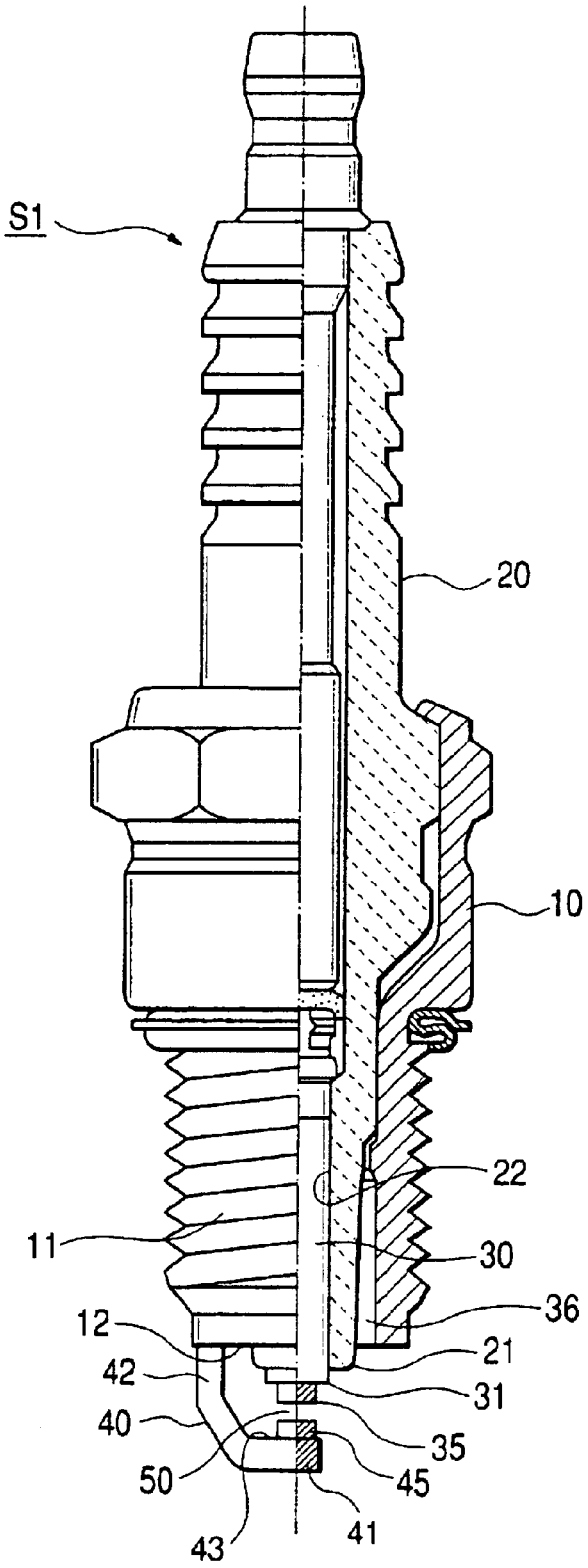
FIG. 1 is a side elevation view, partly in cross section, of a spark plug according to a first embodiment.

FIG. 1 is a side elevation view, partly in cross section, of a spark plug S1 according to this embodiment.

The spark plug S1 includes a tubular metal housing 10 (a steel, such as a low carbon steel) having an inner hole 36 therein and has a thread portion 11 for mounting it on the engine head. The housing 10 supports an insulator 20 made of alumina ceramics ($Al_2O_3$) or the like in the inner hole 36 of the housing 10. A tip 21 of the insulator 20 is exposed to the space at one end 12 of the housing 10.

The insulator 20 supports a central electrode 30 in an axial hole 22 of the insulator 20, so that the housing 10 supports the central electrode 30 with insulation. The central electrode 30 includes an inner material and an outer material around the inner material. The inner material includes a metallic material having a superior heat conductivity such as Cu. The outer material includes a metallic material having a superior heat resistance and a superior corrosion resistance such as Ni-base alloy. In this embodiment, the central electrode 30 has a cylindrical (bar) shape. As shown in FIG. 1, a tip (end surface) 31 of the central electrode 30 is exposed to the space at one end 12 of the housing 10.

The spark plug S1 further includes an earth electrode 40 taking a form of a prism (rectangular column) which comprises a Ni base alloy mainly including Ni. One end 41 of the earth electrode 40 (a tip side surface 43) substantially confronts the tip 31 of the central electrode 30, because the intermediate portion of the earth electrode 40 is bent like letter of L. The other end 42 of the earth electrode 40 is welded to one end 12 of the housing 10. That is, the earth electrode 40 extends from the one end 12 of the housing 10.

Figure 2:
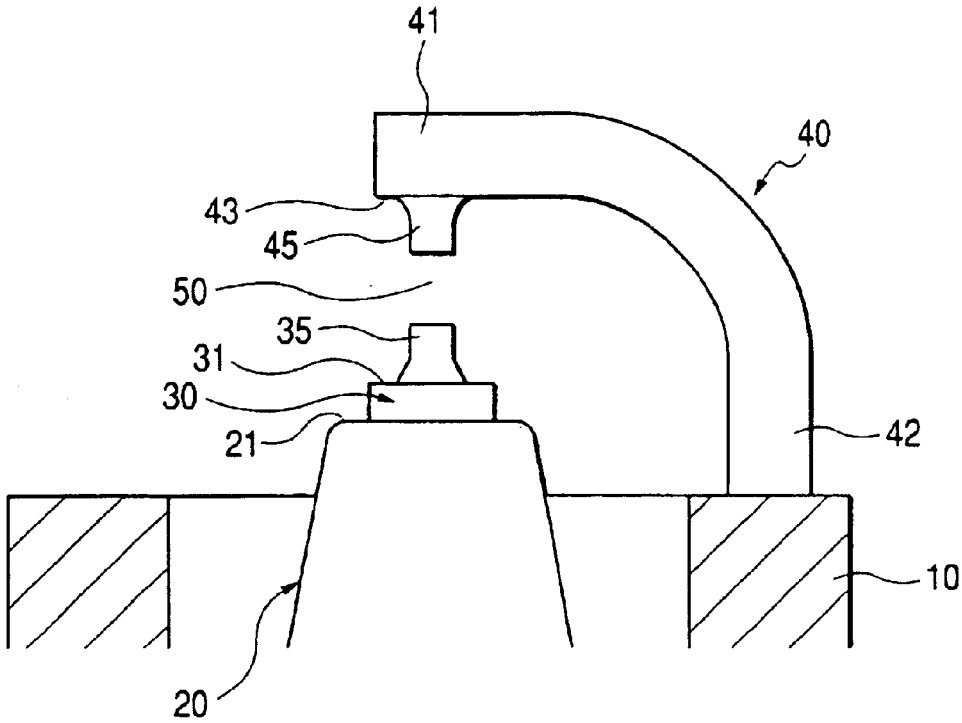
FIG. 2 is an enlarged sectional side elevation view of the spark discharge portion of the spark plug shown in FIG. 1.

FIG. 2 is an enlarged sectional side elevation view of the spark discharge portion of the spark plug S1. The tip 31 of the central electrode 30 faces the tip side surface 43 of the earth electrode 40 through a discharge gap 50. Moreover, on the end surface 31 of the central electrode 30 facing the spark discharge gap 50, a noble metal chip 35 is welded thereto by the laser welding with forming a fused junction layer 37, and on the tip side surface 43 facing the discharge gap 50, a noble metal chip 45 is also welded thereto by laser welding.

These noble metal chips 35 and 45 have cylindrical shapes. One ends of these noble metal chips 35 and 45 are welded to the end surface 31 and the tip side surface 43, respectively, by laser welding.

The noble metal chips 35 and 45 provide the discharge gap 50 for spark discharge. The discharge distance is about 0.7 mm for example.

The noble metal chips 35 and 45 comprise Pt, a Pt alloy, Ir, an Ir alloy or the like. For example, each noble metal comprises an Ir alloy chip mainly including Ir and further includes (is doped with) at least one of Rh, Pt, Ni, W, Pd, Ru, and Os, or a Pt alloy chip mainly includes Pt and further includes (is doped with) at least one of Ir, Ni, Rh, W, Pd, Ru, and Os.

More specifically, the Ir alloy chip mainly includes Ir and doped with at least one of Rh of lower than or equal to 50% by weight, Pt of lower than or equal to 50% by weight, Ni of lower than or equal to 40% by weight, W of lower than or equal to 30% by weight, Pd of lower than or equal to 40% by weight, Ru of lower than or equal to 30% by weight, and Os of lower than or equal to 20% by weight.

Moreover, the Pt alloy chip mainly includes Pt and doped with at least one of Ir of lower than or equal to 50% by weight, Ni of lower than or equal to 40% by weight, Rh of lower than or equal to 50% by weight, W of lower than or equal to 30% by weight, Pd of lower than or equal to 40% by weight, Ru of lower than or equal to 30% by weight, and Os of lower than or equal to 20% by weight.

In this embodiment, both noble metal chips 35 and 45 use an Ir alloy chip having a high melting point and a high wear resistance because it mainly includes Ir and doped with least one of Rh, Pt, Ru, Pd, and W.

Figure 3:
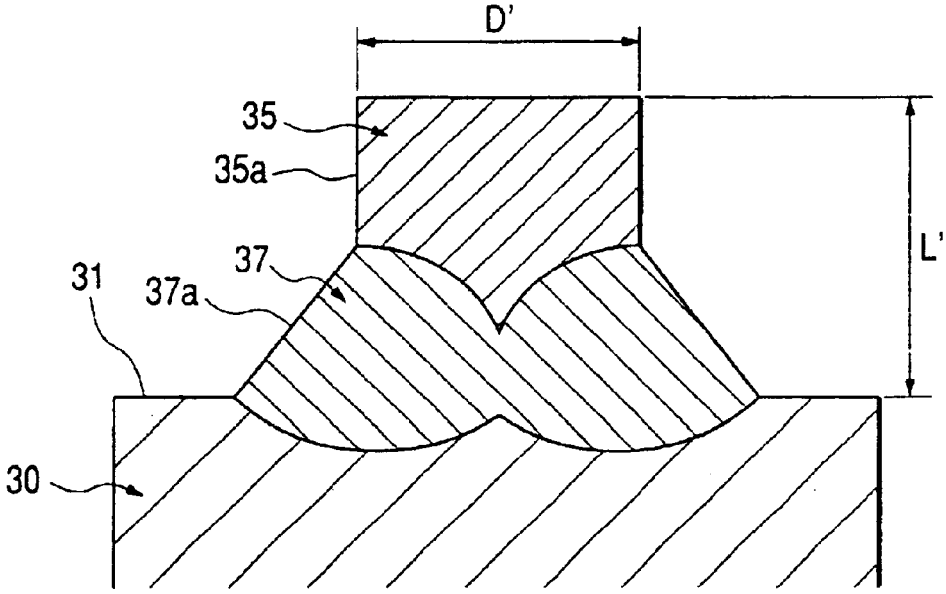
FIG. 3 is a sectional side elevation view of the tip portion of the central electrode, wherein a noble metal chip is welded.

These noble metal chips 35 and 45 can be bonded to the central electrode 30 and the earth electrode 40, respectively, by the bonding method (laser welding) disclosed in the above-mentioned U.S. Pat. No. 6,215,235. FIG. 3 is a sectional side elevation view of the tip portion of the central electrode 30 wherein the noble metal chip 35 components as mentioned above is welded by this method. In this example, the noble metal chip 35 is welded to the end surface 31 of the central electrode 30 by applying a laser beam to a contact portion between the noble metal chip 35 and the end surface 31. As a result, the slope on the fused junction layer 37 between the chip 35 and the end surface 31 of the central electrode 30 on a sectional plane including the axis of the central electrode 30 is straight when it is viewed from the lateral direction regarding the axis of the central electrode 30.

Figure 4:
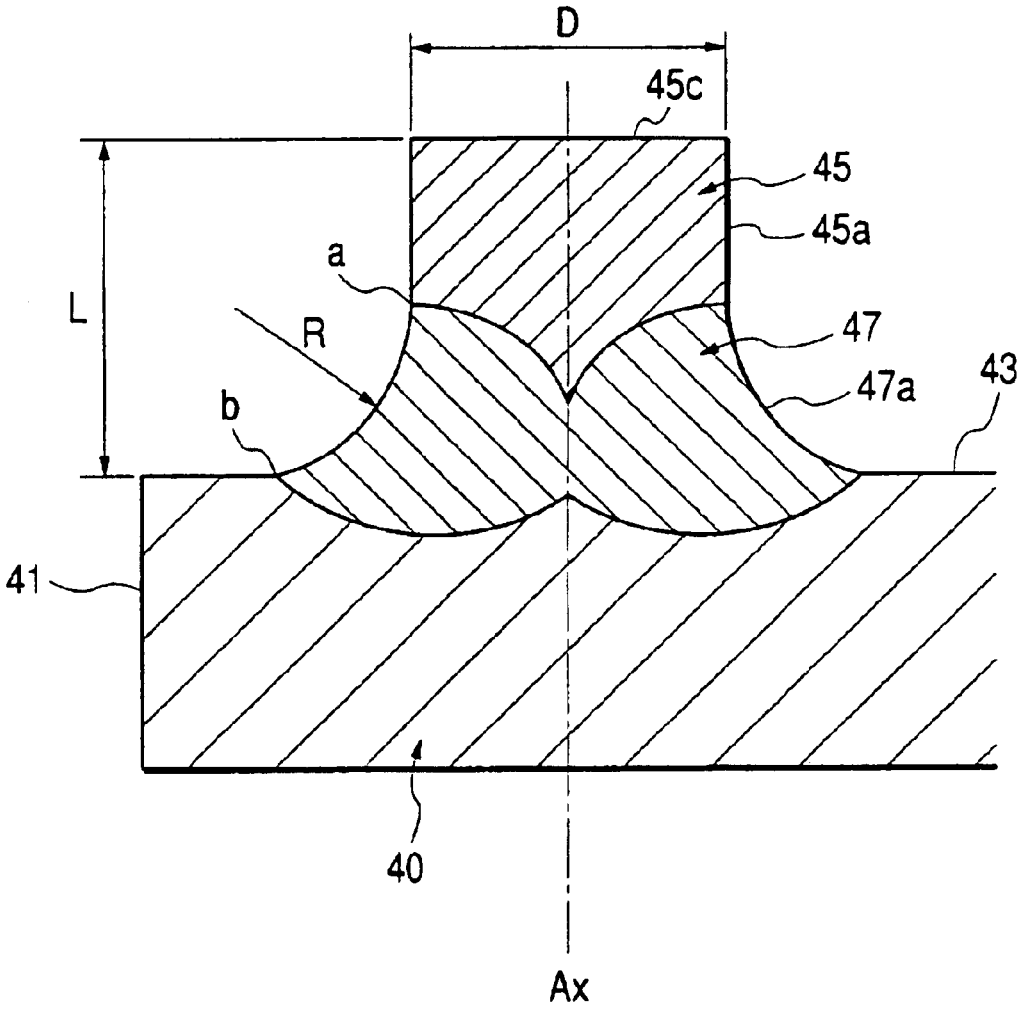
FIG. 4 is a sectional view illustrating a bonding structure at the tip portion of the central electrode according to the embodiment.

In this embodiment, the bonding structure of the chips 35 and 45 are improved to provide a long life and excellent ignitability. FIG. 4 shows this bonding structure according to this embodiment.

As mentioned above, one end of the noble metal chip 45 is welded to the tip side surface 43 of at the tip 41 of the earth electrode 40. The noble metal chip 45 has a sectional area at the other end 45*c* thereof (an area of the top surface of the chip 45) which is not less than 0.12 $mm^2$ and not more than or equal to 1.15 $mm^2$ (from 0.12 $mm^2$ to 1.15 $mm^2$). Moreover, a length L from the side surface 43 to the other end (top surface) 45*c* of the chip 45 is not less than 0.3 mm and not more than 1.5 mm (from 0.3 mm to 1.5 mm). In this example, to provide this condition, the noble metal chip 45 has a cylindrical shape of which diameter D of not less than 0.4 mm and not more than 1.2 mm (from 0.4 mm to 1.2 mm).

Moreover, the slope surface 47*a* on the fused junction layer 47 connecting the side surface 45*a* of the chip 45 to the tip end surface 43 of the earth electrode 41 is curved such that the slope line of the slope surface 47*a* on a sectional plane including the axis AX of the noble metal chip 45 viewed from the direction perpendicular the sectional plane has a radius R. That is, the fused junction layer 47 has a concave surface 47*a*.

This concave surface 47*a* is formed as follows:

FIGS. 5A to 5E are side elevation views illustrating the successive processes of bonding the noble metal chip 45 to the earth electrode 40.

Figures 5A, 5B, 5C, 5D, 5E:
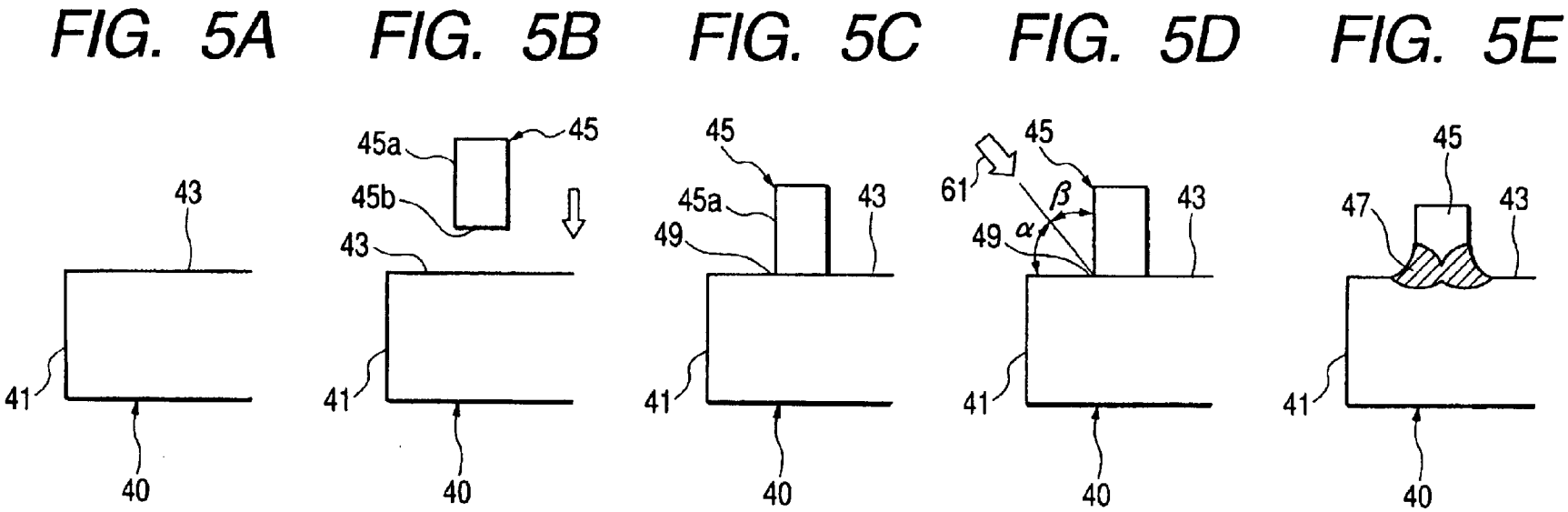
FIGS. 5A to 5E are side elevation views illustrating the successive processes of bonding the noble metal chip to the earth electrode according to this embodiment.

At first, the noble metal chip 45 is placed on the tip side surface 43 of the earth electrode 40 as shown in FIGS. 5A and 5B such that the one end surface 45*b* of the noble metal chip 45 contacts with the tip side surface 43 without sinking. That is, the surface 45*b* agrees with the tip end surface 43 in level.

Next, a laser beam 61 is applied to a corner 49 made between the tip end surface 43 outside the one end surface 45*b* and the side surface 45*a* neighboring the one end surface 45*b* at an inclination angle $\alpha$ to the end surface 43 and an inclination angle $\beta$ to the side surface 45*a*. This melts portions of the noble metal chip 45 and the earth electrode 40 which are fused, so that the fused junction layer 47 is provided as shown in FIGS. 5D and 5E. This operation is done intermittently or continuously around the circular corner 49 to connect the noble metal chip 45 to the earth electrode 40.

As a result, the bonding structure in which the noble metal chip 45 is connected to the earth electrode 40 through the fused junction layer 47 is provided. Moreover, for example, the earth electrode 40 is welded to the housing 10, and then, the central electrode 30 covered with the insulator 20 is fixed in the housing 10. Next, the earth electrode 40 is bent to form the discharge gap 50. This provides the spark plug S1 shown in FIG. 1.

The Reason for Dimensions

As mentioned above, the sectional area of the tip of the noble metal chip 45 is not less than 0.12 $mm^2$ and not more than 1.15 $mm^2$ and the length L is not less than 0.3 mm and not more than 1.5 mm. This reason is as follows:

The inventor had an idea that a thinner diameter of the noble metal chip 45 and a longer length extending from the tip side surface 43 provides easy growth of an ignition fire core. Thus, the inventor experimented to provide a favorable ignitability with easy growth of an ignition fire core by changing the diameter D and the length L between the tip side surface 43 and the top surface 45*c*.

At first, the inventor prepared test samples of spark plugs S1 having various lengths L and then, successively fixed a test sample to conduct the experiment. The inventor assumed the tolerance limit of the number of times of misfiring for a unit interval to be a reference in estimation. Then, the inventor estimates the length L with this reference.

More specifically, the air-fuel mixture ratio is increased from the idling condition, and when the number of times of misfiring for two minutes reaches two, the inventor assumed the air-fuel mixture ratio at this condition as the tolerance limit for actual use (ignitable air-fuel mixture ratio). The experiment is conducted at 650 rpm with an engine having four cylinders and a cubic capacity of 1.6 litters.

On the side of the central electrode 30, a noble metal chip 35 having cylindrical shape with a diameter D' of 0.4 mm, the length L' extending from the end surface 31 of 0.6 mm is used for example. The discharge gap was 0.7 mm for example.

Figure 6:
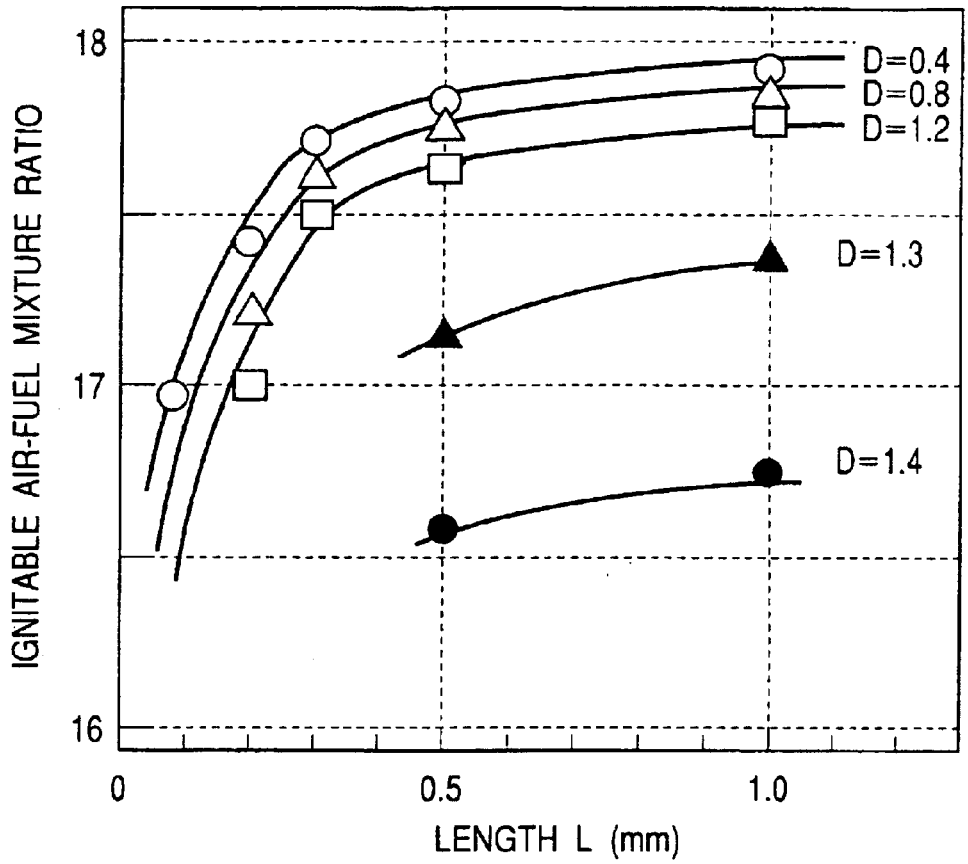
FIG. 6 is a graphical drawing illustrating a relation between ignitable air-fuel mixture ratio and the length L between a surface of the earth electrode and the top surface of the noble metal chip according to this embodiment.

FIG. 6 shows this result. The higher the ignitable air-fuel mixture ratio the more possible the lean burning and thus, this shows a high ignitability. In FIG. 6, the ignitability increases with decrease in the diameter D of the noble metal chip 45. On the other hand, the ignitability largely decreases when the diameter D is increased to 1.3 mm.

In addition, the ignitability increases with increase of the length L of the noble metal chip 45, but the degree of increase in the ignitability saturates if the length L is more than 0.3 mm. This provides the favorable ignition condition with the diameter D of lower than or equal to 1.2 mm (corresponding to the sectional area of 1.15 $mm^2$) and with the length L of higher than or equal to 0.3 mm.

Here, although the noble metal chip 45 has superior heat and wear resistances, the wear resistance decreases if the diameter D decreases under 0.4 mm (corresponding to a sectional area of 0.12 $mm^2$) because discharge sparks concentrate at a point. In addition, if the length L of the noble metal chip 45 extending from the tip side surface 43 is equal to or greater than 1.5 mm, the temperature of the tip of the chip 45 increases significantly, which may melt the noble metal chip 45.

From this, in this embodiment, the noble metal chip 45 on the earth electrode 40 has the sectional area of not less than 0.12 $mm^2$ and not more than 1.15 $mm^2$ (in this example, the diameter D is not less than 0.4 mm and not more than 1.2 mm), and the length L is not less than 0.3 mm and not more than 1.5 mm. These dimensions provide favorable ignitability.

The Reason for Concaving the Slope

As mentioned above, the slope surface 47*a* of the fused junction layer 47 is concaved to have a radius of curvature R when it is viewed from the lateral direction. This structure is provided for improving the connection strength.

If the noble metal chip 45 having the above-mentioned dimensions is welded to the earth electrode 40 by laser according to the technique disclosed in U.S. Pat. No. 6,215,235, the junction structure is the same as that of the central electrode 30 shown in FIG. 3.

Figure 7:
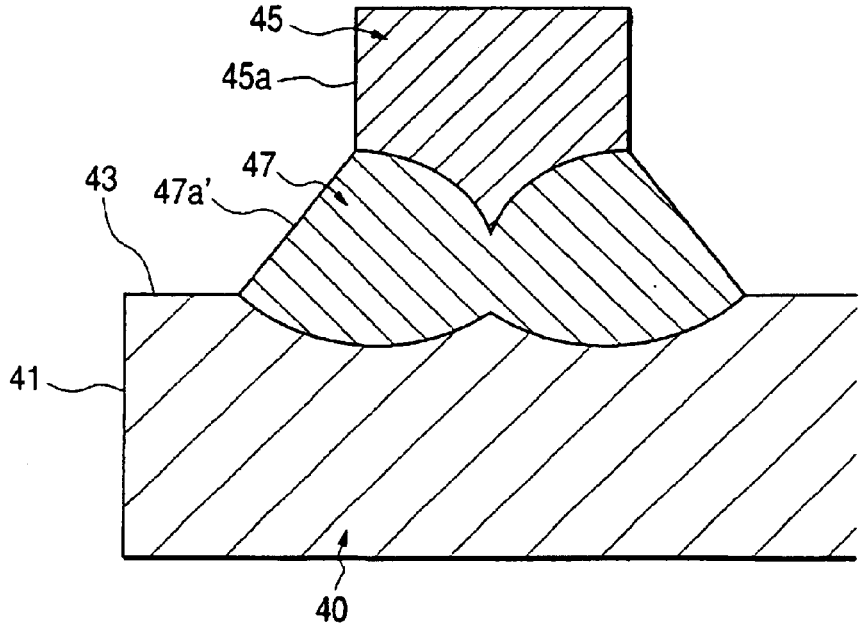
FIG. 7 is a sectional view of the top portion of the earth electrode having the noble metal chip with materials and dimensions according to this embodiment without the concave slope structure at the fused junction layer.

FIG. 7 shows this example, wherein the slope surface 47*a*' at the fused junction layer 47 viewed from the lateral direction (horizontal direction in the drawing) is straight. This fused junction layer 47 has two obtuse angle corners at boundaries between the side surface 45*a* of the noble metal chip 45 and the slope surface 47*a*' and between the tip side surface 43 of the earth electrode 40 and the slope surface 47*a*'. Thus, thermal stresses concentrate at these portions. As a result, cracks may be developed there, so that the noble metal chip 45 may be disconnected from the earth electrode 40.

In consideration of this, the noble metal chip 45 is welded to the earth electrode 40 with the slope surface 47*a* which is concave when viewed from the lateral direction as shown in FIG. 4. More specifically, the side surface 45*a* of the noble metal chip 45 is connected to the slope surface 47*a* of the fused junction layer 47 continuously, and the slope surface 47*a* is also connected to the side surface 43 of the earth electrode 40 continuously. That is, the connected surface is smooth. This prevents thermal stresses from concentrating at boundaries a and b on the surface of the fused junction layer 47, the side surface 45*a*, and the tip side surface 43. Accordingly, the magnitude of the thermal stress at the fused junction layer 47 is reduced. This increases the strength of connecting the noble metal chip 45 to the earth electrode 40.

Here, the inventor assumed the terminal stress at the fused junction layer 37 at the central electrode provided by the above-mentioned conventional laser welding as shown in FIG. 3 as a reference for suppressing the thermal stress at the fused junction layer 47 on the earth electrode side.

This is because the connection strength in the central electrode 30 is sufficient for actual use as mentioned above. Thus, the inventor analyzed the thermal stress at the fused junction layer 47 with variation of the radius of curvature by FEM (finite element method). Similarly, the thermal stress at the fused junction layer 37 on the central electrode side is also analyzed by FEM to provide the reference.

Figure 8A:
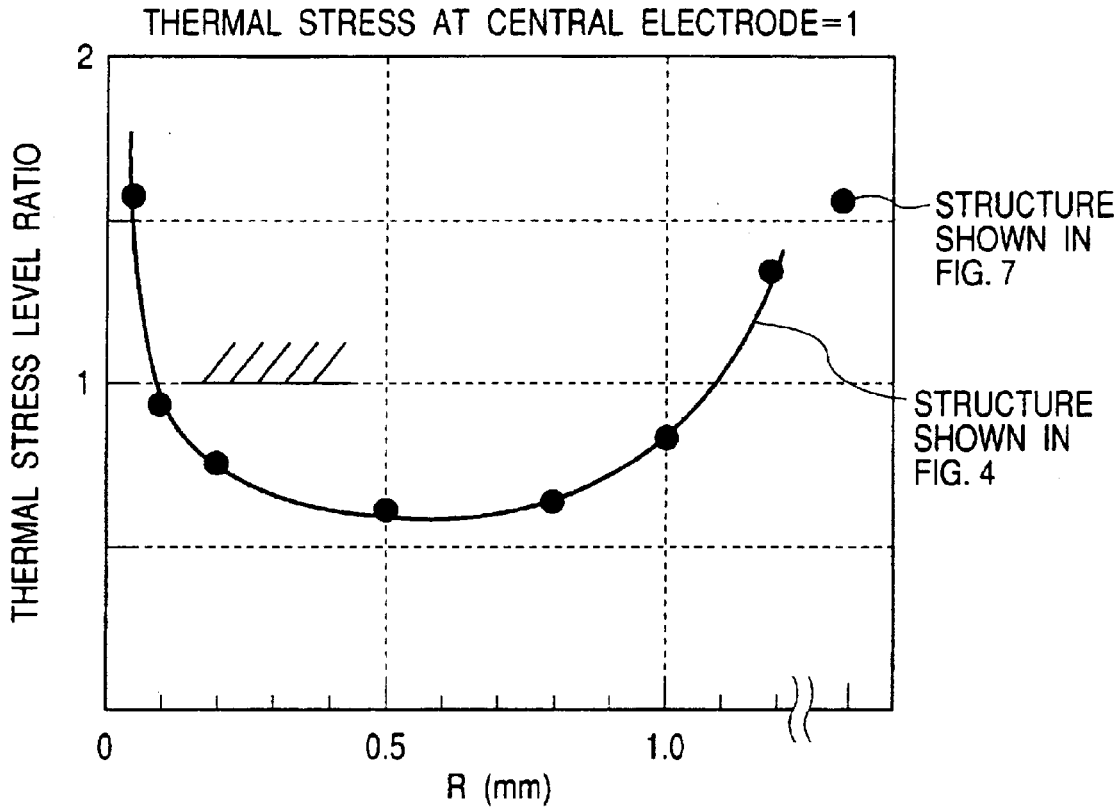
FIG. 8A is a graphical drawing illustrating a relation between the thermal stress level ratio and the radius of the slope of the fused junction layer according to this embodiment.

FIG. 8A shows the thermal stress analysis. Here, for analysis, the diameters D and D' of the noble metal chips 45 and 35 are assumed as 1.2 mm and the length L and L' is 1.0 mm, and the noble chip components of the fused junction layers 37 and 47 are assumed as 35% by weight. This assumption provides a most sever requirement in connection strength. Moreover, it is assumed that thermal stresses are developed at portions of the fused junction layers 37 and 47 near the central electrode 30 and the earth electrode 40, respectively.

In the graph shown in FIG. 8A, the thermal stress level on the earth electrode side is analyzed with variation of the radius of curvature R and is represented by normalizing it with the thermal stress level (=1) on the central electrode side, that is, represented with terminal stress level ratios. At the rightmost of the graph, the thermal stress level ratio in the structure shown in FIG. 7 is shown. This thermal stress is relatively high because the temperature at the earth electrode 40 (for example, 900° C.) is higher than that of the central electrode 30 (for example, 800° C.).

In FIG. 8A, if a radiuses of curvature R providing a thermal stress level ratio is 1 or less, this condition can be judged to provide improvement in the connection strength and provide actual use conditions. That is, the radius of curvature R at the fused junction layer 47 on the earth electrode 40 on the sectional plane including the axis of the noble metal chip 45 is not less than 0.1 mm and not more than 1.0 mm (from 0.1 mm to 1.0 mm).

In FIG. 8A, when the radius of curvature R is lower than 0.1 mm or higher than 1.0 mm, the thermal stress level on the earth electrode side exceeds that on the central electrode side. This is because if the radius of curvature R is lower than 0.1 mm, the slope curvature at the fused junction layer 47 is sharp, so that thermal stress concentrates there. If the radius of curvature R is greater than 1.0 mm, the difference in the improvement becomes small.

From this analysis, according to this embodiment, the slope surface 47*a* of the fused junction layer 47 between the side surface 45*a* of the noble metal chip 45 and the tip side surface 43 is concave on the sectional plane including the axis AX with a radius of curvature R. The radius of curvature R which is not less than 0.1 mm and not more than 1.0 mm.

Figure 8B:
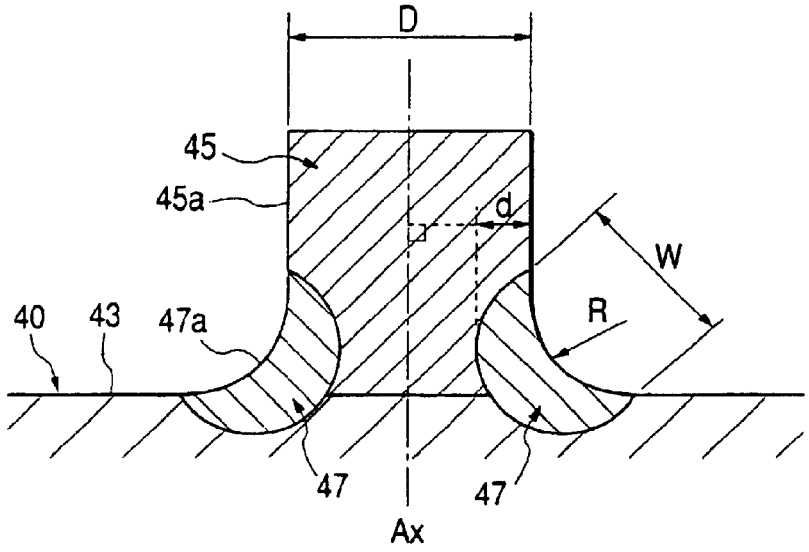
FIG. 8B is a sectional view of the top portion of the earth electrode according to this embodiment.

Moreover, the radius of curvature R is further defined in this embodiment. FIG. 8B is a sectional view of the tip portion of the earth electrode 40. In FIG. 8B, if the radius of curvature R is made smaller, a depth d of melted portion (a thickness of the fused junction layer 47 in a direction perpendicular to the axis AX) may be insufficient.

The inventor experimentally knows that the depth d should be equal to D/4 or higher to provide sufficient connection strength between the noble metal chip 45 and the earth electrode 40. Here, D is the maximum width of noble metal chip 45 on the sectional plane including the axis AX. In this example, since the noble metal chip 45 has a cylindrical form, so that D agrees with the diameter of the noble metal chip 45.

Increase in the depth d increases a nugget width W because the welding energy is higher. This result in increase in the radius of curvature R, so that the improvement in the thermal stress becomes low. On the other hand, decrease in the radius of curvature R decreases the nugget width W. This reduces the depth d, so that the connection strength becomes insufficient.

Then, the inventor experimentally confirmed that the radius of curvature R when d=D/4 (the necessary minimum depth) provides necessary minimum connection strength. According to this embodiment, D of the noble metal chip 45 on the earth electrode side is not less than 0.4 mm and not more than 1.2 mm. The inventor obtained the radius of curvature R satisfying the condition of d=D/4 within this range of D through an experiment. As the result, R=D/4 (D×¼).

Moreover, from an FEM analysis, it is favorable that R is 3D/4 (D×¾) to provide the favorable radius of curvature R according to this embodiment. Accordingly, both to provide the favorable radius of curvature R to suppress thermal stress and to provide the connection strength with the fused junction layer 47, if the maximum width of the noble metal chip 45 on the sectional plane including the axis AX is D, the radius of curvature R of the fused junction layer 47 is favorably not less than D/4 and not more than 3D/4 ($D/4 \leqq R \leqq 3D/4$).

Moreover, according to this embodiment, it is favorable that the component of the noble metal chip 45 at the fused junction layer 47 is not less than 35% by weight and not more than 80% by weight (from 35% by weight to 80% by weight).

The Reason for Ratio of Noble Metal Chip Component

The connection strength varies with the ratio of the components of the noble metal chip 45 in the fused junction layer 47 because the fused metal layer 47 is provided as the result of blending (alloying) the noble metal chip 45 with the material of the earth electrode (Ni base metal) 40. Thus, the connection strength varies with the ratio of the components of the noble metal chip 45. Then, the inventor conducted an FEM analysis about the relation between the ratio between the noble metal chip component and thermal stress.

Figure 9:
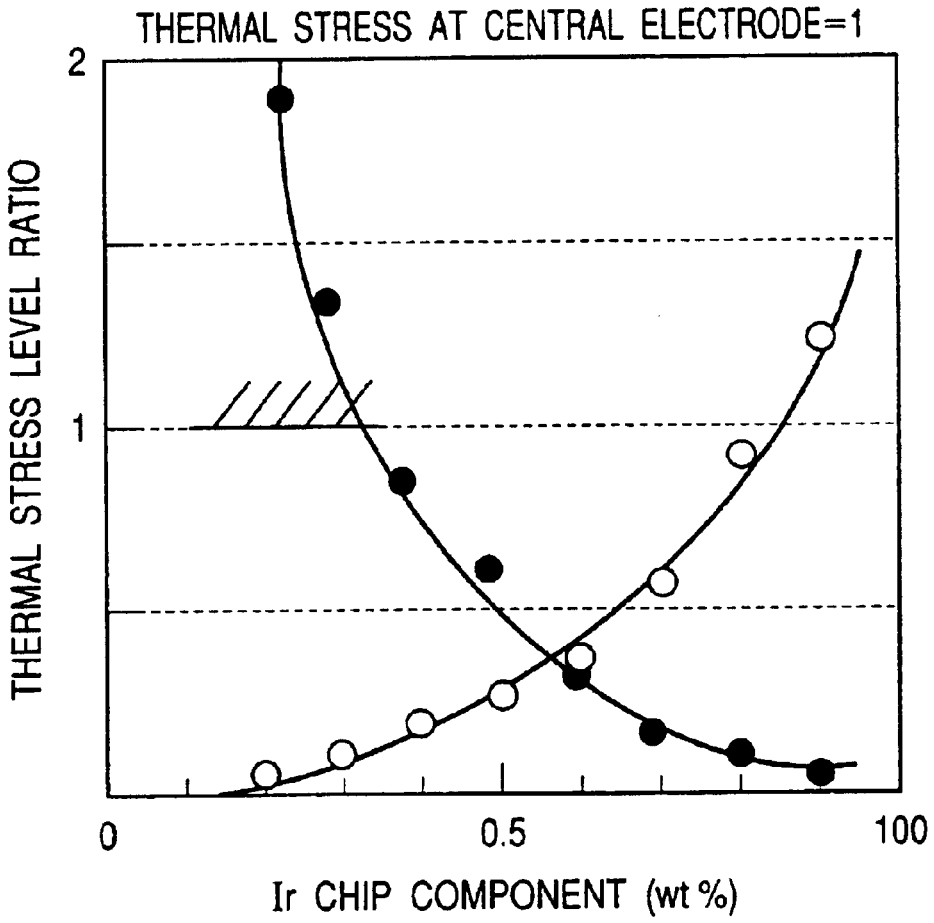
FIG. 9 is a graphical drawing illustrating the relation between the thermal stress level ration and the ratio of the component of the noble metal chip according to this embodiment.

FIG. 9 shows an example of the analysis result. In this analysis, an Ir alloy chip is used as the noble metal chip 45 on the earth electrode 40. The graph in FIG. 9 represents a relation between the ratio of the Ir alloy component (% by weight) in the fused junction layer 47 and the thermal stress level, that is, thermal stress at the earth electrode 40 with assumption that the thermal stress level in the central electrode is one. In FIG. 9, dots represent thermal stress level ratios at the point a at fused junction layer 47 in FIG. 4, that is, the boundary between the noble metal chip 45 and the fused junction layer 47. Circles in FIG. 9 represent thermal stress level ratios at the point b at fused junction layer 47 in FIG. 4, that is, the boundary between the fused junction layer 47 and the earth electrode 40.

In FIG. 9, normalization is made with the thermal stress at the central electrode. Thus, the diameter D' and length L' of the noble metal chip 35 on the central electrode 30 are equalized to the diameter D and length L of the noble metal chip 45 on the earth electrode 40, respectively. Moreover, the ratio of the chip component in the fused junction layer 37 on the central electrode 30 is selected at the lowest value for actual use, that is, 35% by weight in this example. Moreover, in this example, both noble metal chips 35 and 45 include Ir of 90% by weight and Rh of 10% by weight, although these values are not essential.

From the result shown in FIG. 9, to suppress the thermal stress at point a (the boundary between the noble metal chip 45 and the fused junction layer 47), the ratio of the component of the noble metal chip 45 more than 35% by weight is preferred. On the other hand, to suppress the thermal stress at point b (the boundary between the fused junction layer 47 and the earth electrode 40), the ratio of the component of the noble metal chip 45 lower than 80% by weight is preferred.

In addition, because the noble metal chip 45 on the earth electrode 40 is further exposed to the combustion chamber, in other words, the noble metal chip 45 is far from the housing 10 (heat sink), the noble metal chip 45 has a higher temperature than the earth electrode 40, the thermal stress at the boundary between the noble metal chip 45 and the fused junction layer 47 is higher than that at the boundary between the fused junction layer 47 and the earth electrode 40. Accordingly, in selecting the ratio of the component of the noble metal chip in the fused junction layer 47, the thermal stress at the point a is mainly considered preferably.

As mentioned above, according to this embodiment, in a laser welding for bonding the noble metal chip 45 to the earth electrode 40, the diameter D and length L of the noble metal chip 45 on the earth electrode are specified to improve the connection strength with sufficient ignitability.

Moreover, according to this embodiment, the process shown in FIGS. 5A to 5E provides the laser welding structure with a superior connection strength by forming a smooth surfaces at points a and b.

[Modifications]

Figure 10A:
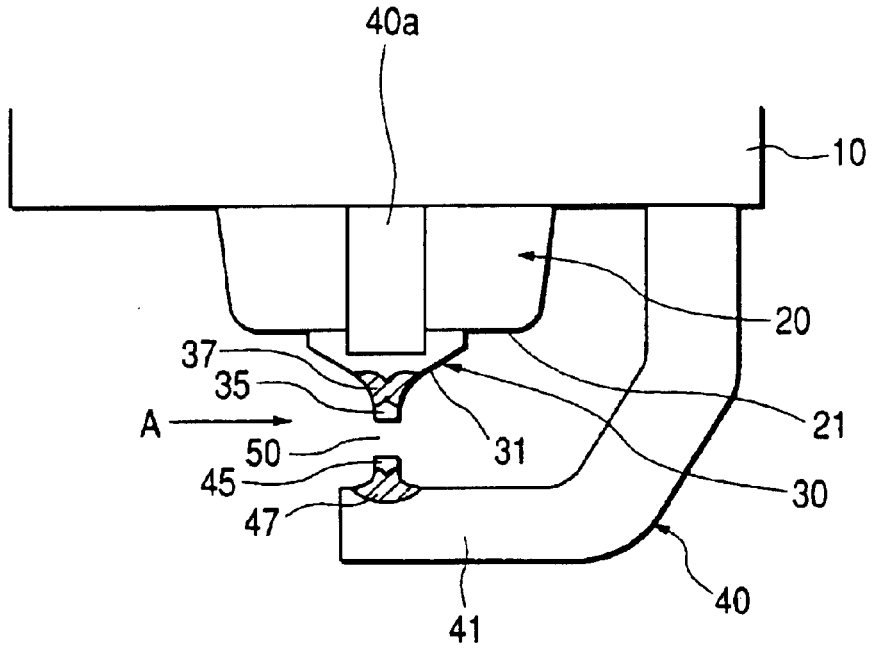
FIG. 10A is a side elevation view of a modification according to this invention.
Figure 10B:
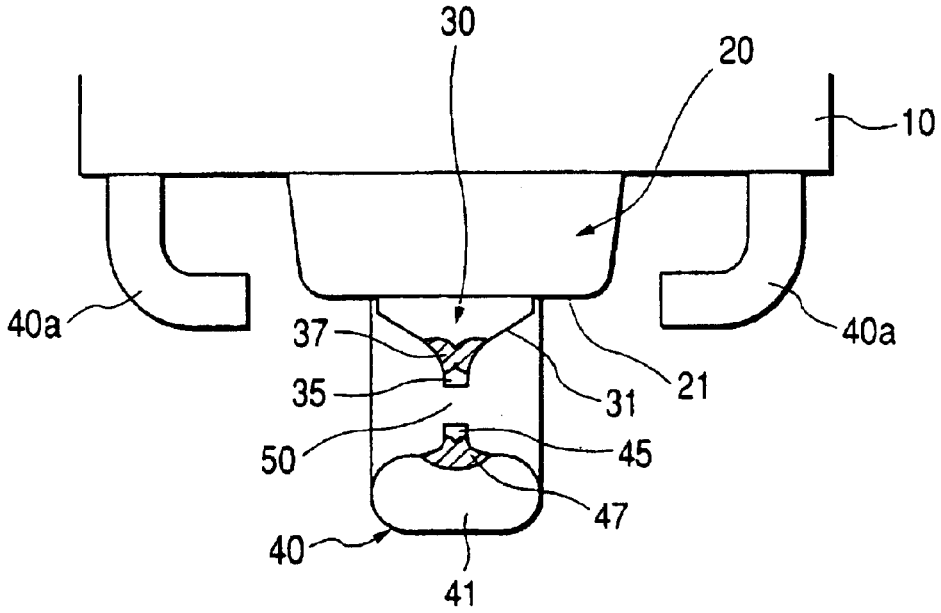
FIG. 10B is another side elevation view of the modification shown in FIG. 10A.

This invention is applicable to a spark plug including subearth electrodes 40*a* in addition to the central electrode 30 and a main earth electrode 40 forming a spark gap therebetween. FIG. 10A shows a partial side elevation view of this spark plug. FIG. 10B shows another side view of the discharge portion of the spark plug viewed from the direction A shown in FIG. 10A.

In this spark plug, the noble metal chi 45 has the dimensions as mentioned above and is welded as mentioned above. Thus, this spark plug has a superior connection strength of the noble metal chip 45 on the earth electrode 40 with sufficient ignitability. Moreover, this modified spark plug further provides a carbon-contamination resistance.

Moreover, the use of a material obtained by doping Al of 1.5% by weight to a Ni base alloy such as inconel (registered trademark) for the earth electrode 40 provides a spark plug with high ignitability and high heat and oxidation resistances.

Figure 11A:
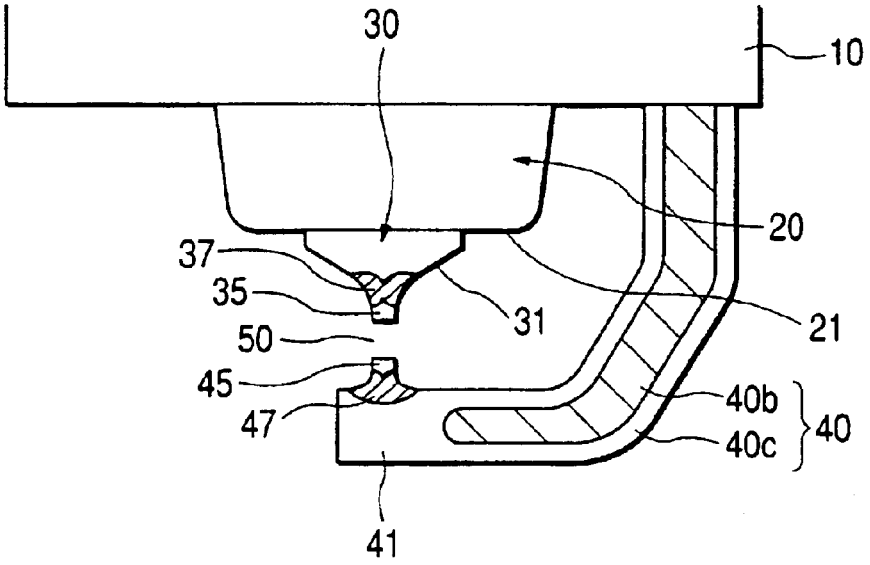
FIG. 11A is a side elevation view of another modification according to this invention.

FIG. 11A shows another modification. In this modification, the earth electrode 40 includes a Cu 40*b* member and a covering material 40*c* made of a Ni base alloy covering the Cu member 40*b*. This structure improves the heat conductivity of the earth electrode 40, so that the heat and oxidation resistances are improved.

Figure 11B:
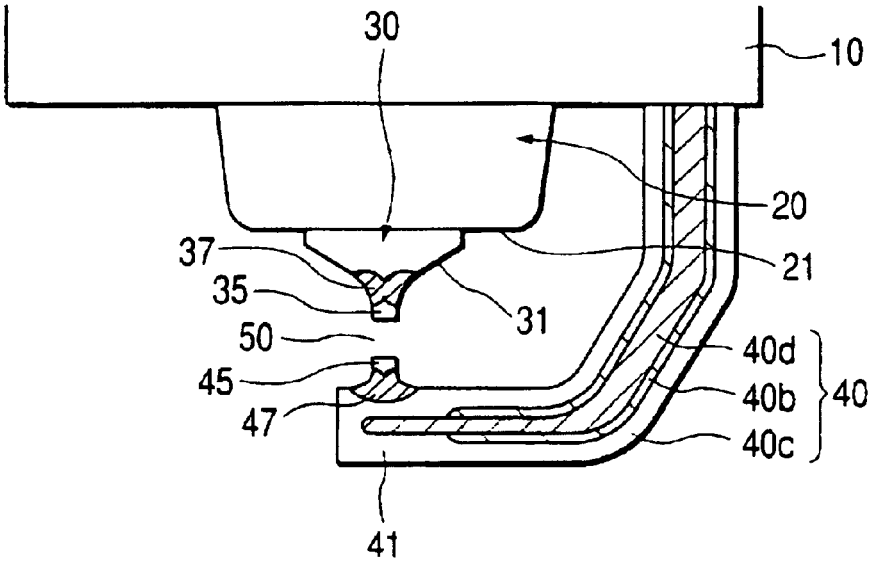
FIG. 11B is a side elevation view of still another modification according to this invention.

FIG. 11B shows still another modification. This spark plug further includes a core material in the Cu material 40*b*. That is, the Ni material 40*d* is covered wit the Cu material 40*b*, and this is further covered with the covering material 40*c* to provide an improved earth electrode.

What is claimed is:

1. A spark plug comprising:

a tubular housing;

a central electrode supported by said tubular housing in said tubular housing with electrical insulation therebetween;

an earth electrode extending from one end of said tubular housing;

a chip, arranged at an end surface of said earth electrode to face said central electrode, for providing a spark gap between said central electrode and said chip, said chip including a noble metal; and a fused junction layer between said earth electrode and said chip including components of said chip and said earth electrode to fix said chip to said earth electrode, wherein a cross-sectional area of said chip at a tip thereof on the opposite side of said fused junction layer is not less than 0.12 $mm^2$ and not more than 1.15 $mm^2$, and a length from said end surface to a top surface of said tip is not less than 0.3 mm and not more than 1.5 mm, and wherein said fused junction layer has a curved outer surface continuously connecting a peripheral outer surface of said chip to said end surface of said earth electrode, said curved outer surface being concave toward an axis of said chip, said curved outer surface being tapered toward said chip.

2. The spark plug as claimed in claim 1, wherein said chip mainly includes Ir and further includes at least one of Rh, Pt, Ni, W, Pd, Ru, and Os.

3. The spark plug as claimed in claim 2, wherein said chip mainly includes Ir and further includes at least one of Rh of lower than or equal to 50% by weight, Pt of lower than or equal to 50% by weight, Ni of lower than or equal to 40% by weight, W of lower than or equal to 30% by weight, Pd of lower than or equal to 40% by weight, Ru of lower than or equal to 30% by weight, and Os of lower than or equal to 20% by weight.

4. The spark plug as claimed in claim 2, wherein said fused junction layer includes said component of said chip of not less than 35% by weight and not more than 80% by weight.

5. The spark plug as claimed in claim 1, wherein said chip mainly includes Pt and further includes at least one of Ir, Ni, Rh, W, Pd, Ru, and Os.

6. The spark plug as claimed in claim 5, wherein said chip mainly includes Pt and further includes at least one of Ir of lower than or equal to 50% by weight, Ni of lower than or equal to 40% by weight, Rh of lower than or equal to 50% by weight, W of lower than or equal to 30% by weight, Pd of lower than or equal to 40% by weight, Ru of lower than or equal to 30% by weight, and Os of lower than or equal to 20% by weight.

7. The spark plug as claimed in claim 5, wherein said fused junction layer includes said component of said chip of not less than 35% by weight and not more than 80% by weight.

8. The spark plug as claimed in claim 1, wherein said curved outer surface has a radius of curvature R in a sectional plane including said axis of said chip.

9. The spark plug as claimed in claim 8, wherein if it is assumed that a maximum width of said chip on a sectional plane along said axis is D, $D/4 \leqq R \leqq 3D/4$.

* * * * *